US009787026B2

(12) United States Patent
Scherer et al.

(10) Patent No.: US 9,787,026 B2
(45) Date of Patent: Oct. 10, 2017

(54) ELECTRIC PLUG CONNECTOR ARRANGEMENT

(71) Applicant: Kostal Kontakt Systeme GmbH, Luedenscheid (DE)

(72) Inventors: Thomas Scherer, Luedenscheid (DE); Petr Spunar, Nizbor (CZ); Vojtech Leopold, Dobris (CZ); Rainer Buethe, Meinerzhagen (DE); Jiri Keclik, Dobris (CZ)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 15/453,151

(22) Filed: Mar. 8, 2017

(65) Prior Publication Data

US 2017/0179647 A1 Jun. 22, 2017

Related U.S. Application Data

(63) Continuation of application No. PCT/EP2015/073044, filed on Oct. 6, 2015.

(30) Foreign Application Priority Data

Oct. 9, 2014 (DE) ..... 10 2014 015 027

(51) Int. Cl.
*H01R 13/641* (2006.01)

(52) U.S. Cl.
CPC ..... *H01R 13/641* (2013.01)

(58) Field of Classification Search
CPC ..... H01R 13/7032; H01R 13/641
(Continued)

(56) References Cited

U.S. PATENT DOCUMENTS 4,298,237 A * 11/1981 Griffith ..... H05K 1/117 439/60
4,900,267 A * 2/1990 Nagasaka ..... H01R 13/641 439/489
(Continued)

FOREIGN PATENT DOCUMENTS

DE 19600542 A1 7/1996
DE 69606590 T2 10/2000
(Continued)

OTHER PUBLICATIONS

European Patent Office, International Search Report for the corresponding International Application No. PCT/EP2015/073044, dated Dec. 21, 2015.
(Continued)

*Primary Examiner* — Ross Gushi
(74) *Attorney, Agent, or Firm* — Brooks Kushman P.C.

(57) ABSTRACT

An electrical connector includes first and second connector parts and an electrical connection detector. The electrical connection detector includes a contact spring with a spring contact on the first connector part and a contact strip on the second connector part. The electric connection detector establishes an electrical connection between the contact spring and the contact strip when the connector parts are joined together. The second connector part includes an electrically insulating protrusion which forms a guide bevel that rises in a joining direction of the first connector part toward the second connector part. The spring contact is guided over the guide bevel, rests behind the protrusion, and physically contacts the contact strip when the connector parts are joined together to thereby establish an electrical connection between the contact spring and the contact strip.

16 Claims, 5 Drawing Sheets

(58) Field of Classification Search
USPC ..... 439/489
See application file for complete search history.

(56) References Cited

U.S. PATENT DOCUMENTS

| | | | |
|---|---|---|---|
| 5,088,931 | A | 2/1992 | Niciolo et al. |
| 5,624,275 | A | 4/1997 | Fukuda |
| 5,775,936 | A | 7/1998 | Tsuji |
| 6,257,922 | B1 | 7/2001 | Shinozaki |
| 7,287,993 | B2 | 10/2007 | Fujii et al. |
| 9,017,096 | B2 | 4/2015 | Casses et al. |
| 2007/0082549 | A1 | 4/2007 | Fujii et al. |
| 2013/0303006 | A1 | 11/2013 | Casses et al. |

FOREIGN PATENT DOCUMENTS

| | | | |
|---|---|---|---|
| EP | 0917250 | A1 | 5/1999 |
| EP | 1775801 | A1 | 4/2007 |
| WO | 2012023042 | A2 | 2/2012 |

OTHER PUBLICATIONS

German Patent Office, German Search Report for the corresponding German Patent Application No. DE 10 2014 015 027.5 dated Jun. 23, 2015.

* cited by examiner

ELECTRIC PLUG CONNECTOR ARRANGEMENT

CROSS-REFERENCE TO RELATED APPLICATIONS

This application is a continuation of International Application No. PCT/EP2015/073044, published in German, with an International filing date of Oct. 6, 2015, which claims priority to DE 10 2014 015 027.5, filed Oct. 9, 2014; the disclosures of which are hereby incorporated in their entirety by reference herein.

TECHNICAL FIELD

The present invention relates to an electric plug connector arrangement having joinable first and second plug connector parts and an electrical connection detection device, the first plug connector part having first plug contact elements and the second plug connector part having second plug contact elements, the electrical connection detection device including a contact spring on the first plug connector part and a contact strip on the second plug connector part, and the electrical connection detection device establishes an electrical connection between the contact spring and the contact strip when the first and second plug connector parts are joined together.

BACKGROUND

DE 196 00 542 A1 (corresponding to U.S. Pat. No. 5,624,275) describes an electric plug connector arrangement having joinable first and second plug connector parts. The first plug connector part has a short circuit contactor that electrically connects two connection detection terminals at the second plug connector part to one another after the plug connector parts are joined together.

First and second plug connector parts of an electric plug connector arrangement, when used as intended, have first and second plug contact elements, respectively, via which load currents or useful signals are transmitted between feed lines connected to the plug contact elements after the plug connector parts are joined together. Some electric plug connector arrangements also have an electrical connection detection device.

An electrical connection detection device has the function, when the plug connector parts are correctly and completely joined, of generating an electrical signal which indicates the correct established plug-in connection. The signal may be used for controlling current flow through feed lines of the plug connector parts. As such, for example, the plug connector parts may be connected to one another without current.

For multipole plug connector arrangements, complementary plug contact elements of the plug connector parts not otherwise needed may be used as the electrical connection detection device. However, this results in disadvantageous properties because axially joined plug connector parts have a certain plug-in path (e.g., a certain plug-in distance). Consequently, the complementary plug contact elements used as the electrical connection detection device may thus contact one another and generate a signal before the plug-in operation is fully completed and a secure connection of the other plug contact elements of the plug connector parts is ensured.

For safety reasons and to avoid switching sparks, when the plug connector parts are joined together it is desirable for the contacts of the electrical connection detection device to close after all other electrical connections have been established (i.e., close after the electrical connections between the plug contact elements of the plug connector parts have been established). Conversely, when the plug connector parts are disconnected from one another it is desirable for the contacts of the electrical connection device to open before all other electrical connections have been removed (i.e., open before the electrical connections between the plug contact elements of the plug connector parts have been removed). That is, the contacts of the electrical connection detection device should be the first to be separated when the plug connector parts are disconnected to signal interruption of the plug-in connection as early as possible and optionally to allow disconnection of the plug contact elements of the plug connector parts without current.

SUMMARY

An object includes an electric plug connector having joinable first and second plug connector parts and an electrical connection detection device which reliably meets the above-mentioned requirements in a simple and cost-effective manner.

In carrying out at least one of the above and/or other objects, an electrical connector is provided. The electrical connector includes a first connector part, a second connector part, and an electrical connection detector. The electrical connection detector includes a contact spring with a spring contact on the first connector part and a contact strip on the second connector part. The electric connection detector establishes an electrical connection between the contact spring and the contact strip when the connector parts are joined together. The second connector part includes an electrically insulating protrusion which forms a guide bevel that rises in a joining direction of the first connector part toward the second connector part. The spring contact is guided over the guide bevel, rests behind the protrusion, and physically contacts the contact strip when the connector parts are joined together to thereby establish an electrical connection between the contact spring and the contact strip.

An embodiment provides an electric plug connector arrangement including first and second plug connector parts which can be joined together and an electric connection detection device. The first and second plug connector parts have first and second plug contact elements, respectively. The electric connection detection device includes a contact spring element having a contact spring with a spring contact on the first plug connector part. The electric connection detection device further includes a contact strip on the second plug connector part. The contact spring element and the contact strip represent connection detection contacts of the electric connection detection device. The contact strip on the second plug connector part is led through a wall of the second plug connector part. The electric connection detection device produces an electric connection between the contact spring on the first plug connector part and the contact strip on the second plug connector part when the plug connector parts are joined together.

The second plug connector part has an electrically insulating protrusion which forms a guide bevel. The guide bevel rises in the joining direction of the first plug connector part toward the second plug connector part. The spring contact of the contact spring on the first plug connector part is guided over the guide bevel when the plug connector parts are joined together. At the end of the joining operation of the plug connector parts, the spring contact of the contact spring on the first plug connector part rests behind the protrusion onto the contact strip on the second plug connector part.

In embodiments, a ramp-like protrusion is thus provided over which the spring contact of the contact spring on the first plug connector part is guided when the plug connector parts are joined together. As explained herein, rapid and precisely positioned connection and disconnection of the connection detection contacts of the electric connection detection device may thus be achieved. The electric plug connector arrangement may be designed such that the electrical connection state of the connection detection contacts is sensitively dependent on precise positioning of the plug connector parts relative to one another. Incompletely established plug-in connections are thus recognized with a high level of reliability.

BRIEF DESCRIPTION OF THE DRAWINGS

Two exemplary embodiments of an electric plug connector arrangement in accordance with the present invention are illustrated in the drawings and explained in greater detail below. The drawings include following.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of components. Therefore, specific structural and functional details disclosed herein are not to be interpreted as limiting, but merely as a representative basis for teaching one skilled in the art to variously employ the present invention.

Referring now to FIGS. 1, 2, 3, 4, and 9, a first electric plug connector arrangement will be described. Electric plug connector arrangements described herein may advantageously be used in motor vehicles.

Figure 1:
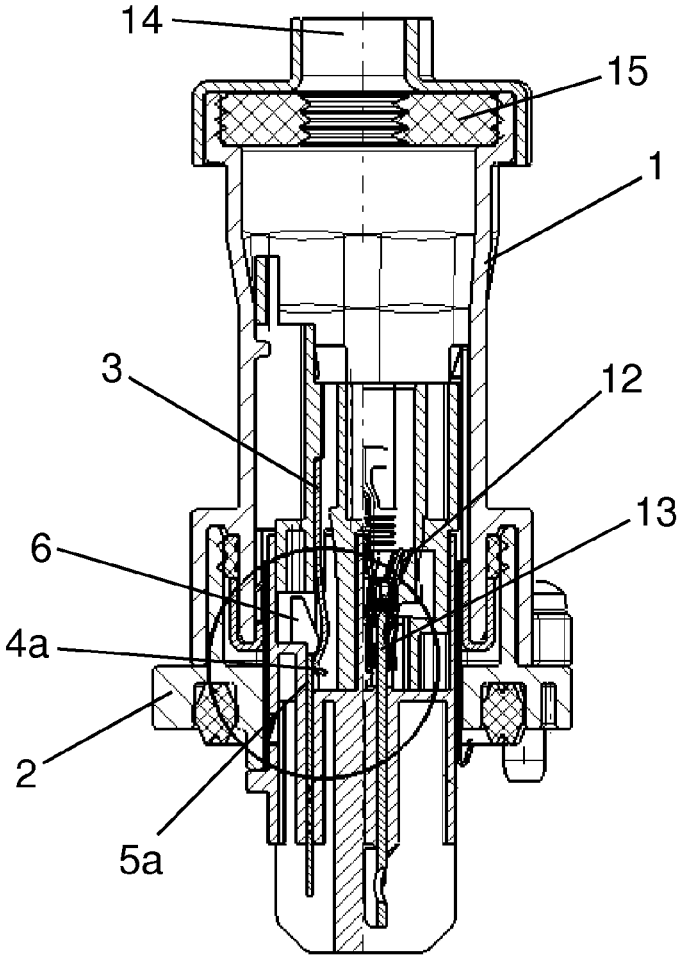
FIG. 1 illustrates a sectional view of a first electric plug connector arrangement, the first electric plug connector arrangement having a first plug connector part, a second plug connector part, and an electric connection detection device.

As best shown in FIG. 1, the electric plug connector arrangement includes a first plug connector part 1, a second plug connector part 2, and an electric connection detection device. First and second plug connector parts 1 and 2 are interconnectable (e.g., joinable) with one another.

First plug connector part 1 includes one or more push-on, sleeve-like first plug contact elements 12. Second plug connector part 2 includes one or more plug-like second plug contact elements 13. First and second plug contact elements 12 and 13 may be designed for high voltages and/or high load currents. Second plug contact elements 13 are pluggable into corresponding ones of first plug contact elements 12. Complementary first and second plug contact elements 12 and 13 plug into one another when first and second connector parts 1 and 2 are joined with one another.

As shown in FIG. 1, first plug connector part 1 includes a passage opening 14. A radial seal 15 encircles passage opening 14. A connecting line such as electrical cable (not shown) may lead through passage opening 14 into the interior of first plug connector part 1. Line wires of a connecting line extending into the interior of first plug connector part 1 establish electrical connections with first plug contact elements 12 of first plug connector part 1. End sections of second plug contact elements 13 of second plug connector part 2 lead out from the second plug connector part. These end sections of second plug contact elements 13 which lead out from second plug connector part 2 are likewise used for connecting electrical feed lines. The specific configuration of the electrical connections of plug contact elements 12 and 13 is of secondary importance for explaining electric plug connector arrangements in accordance with embodiments of the present invention and therefore are not illustrated in further detail in the drawings. The electrical connections may be designed in a known manner, for example, as crimped, screwed, or plug-in connections.

For many applications, it is important to accurately determine the mechanical and electrical connection state of the plug connector arrangement. Information concerning the connection state may be used, for example, for enabling or interrupting current flow across plug contact elements 12 and 13 of the plug connector arrangement via electrically controllable switching elements.

In this regard, the electric connection detection device of the plug connector arrangement is advantageous for the following reasons. The electric connection detection device has a low response hysteresis that signals an established connection only after a plug-in connection has been fully established (i.e., only after an electrical connection has been ensured). When the plug-in connection is disconnected, the electric connection detection device quickly identifies that a complete plug-in connection is no longer present due to discontinuation of the connection signal.

Figure 2:
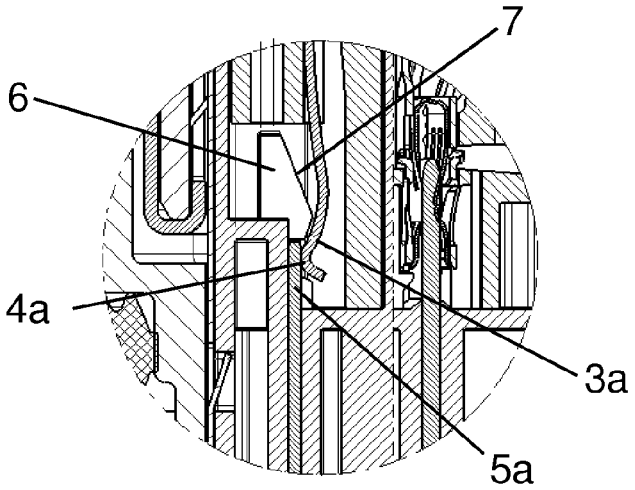
FIG. 2 illustrates an enlarged view of the circled area in FIG. 1 of the first electric plug connector arrangement when the first and second plug connector parts are in a final joining position between one another.
Figure 3:
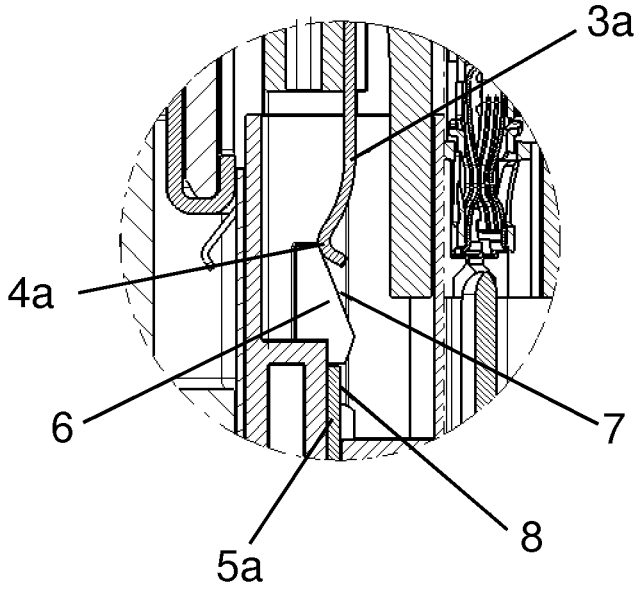
FIG. 3 illustrates an enlarged view of the circled area in FIG. 1 of the first electric plug connector arrangement when the first and second plug connector parts are in an initial joining position between one another.
Figure 4:
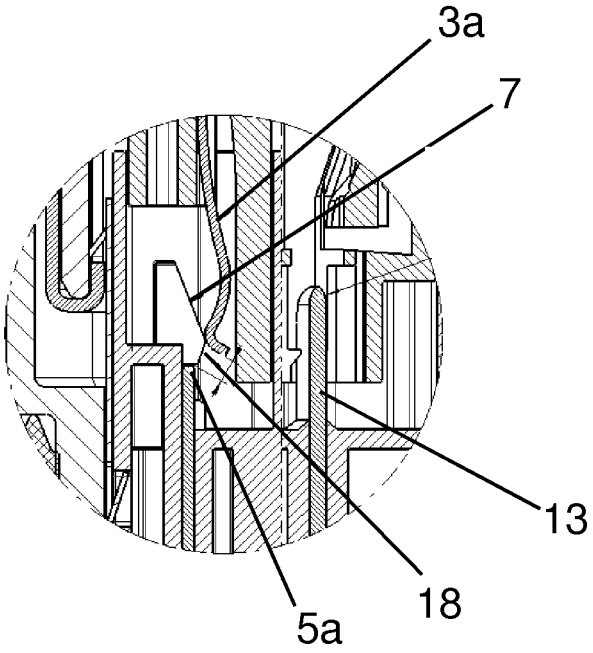
FIG. 4 illustrates an enlarged view of the circled area in FIG. 1 of the first electric plug connector arrangement when the first and second plug connector parts are in an intermediate joining position between one another.

FIGS. 2, 3, and 4 each illustrate an enlarged view of the circled area in FIG. 1 of the first plug connector arrangement. In FIG. 2, first and second plug connector parts 1 and 2 are in a final joined position (i.e., fully interconnected) between one another. In FIG. 3, first and second plug connector parts 1 and 2 are in an initial joining position between one another. In FIG. 4, first and second plug connector parts 1 and 2 are in an intermediate joining position between one another.

Figure 9:
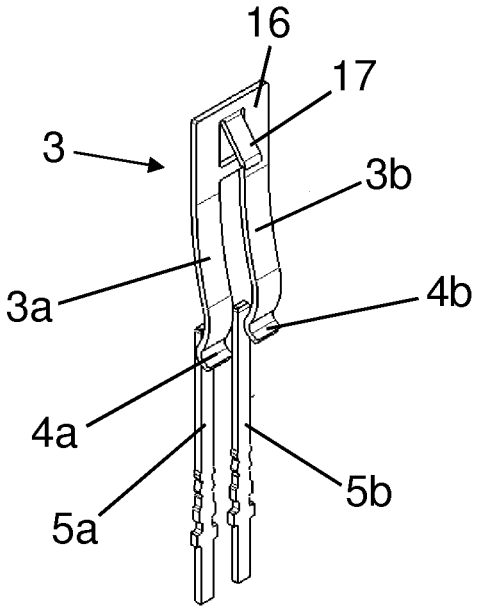
FIG. 9 illustrates the connection detection contacts of the electric connection detection device of the first electric plug connector arrangement shown in FIGS. 1, 2, 3, and 4.

The electric connection device includes a contact spring element 3 on first plug connector part 1 and first and second contact strips 5*a* and 5*b* on second plug connector part 2. FIG. 9 illustrates a perspective view of contact spring element 3 and contact strips 5*a* and 5*b*. As shown in FIG. 9, contact spring element 3 includes a first contact spring 3*a* for first contact strip 5*a* and a second contact spring 3*b* for second contact strip 5*b*. A section of first contact spring 3*a* at its end section forms a rounded spring contact 4*a* and a section of second contact spring 3*b* at its end section forms a rounded spring contact 4*b*. As shown in FIG. 1, contact strips 5*a* and 5*b* on second plug connector part 2 lead out through a wall of the second plug connector part.

As indicated, the electric connection detection device produces an electric connection between contact spring 3*a* on first plug connector part 1 and contact strip 5*a* on second plug connector part 2 when the plug connector parts are joined together. The electric connection between contact spring 3*a* on first plug connector part 1 and contact strip 5*a* on second plug connector part 2 is produced as rounded spring contact 4*a* of contact spring 3*a* rests with its convexly shaped side against contact strip 5*a*. (Likewise, the electric connection detection device produces an electric connection between contact spring 3*b* on first plug connector part 1 and contact strip 5*b* on second plug connector part 2 when the plug connector parts are joined together.)

As shown in FIG. 9, contact spring 3*a* is part of contact spring element 3. Contact spring element 3 forms two contact springs 3*a* and 3*b* situated in parallel. Contact spring element 3 further includes a connecting section 16. Contact springs 3*a* and 3*b* via connecting section 16 are connected to one another in one piece. Connecting section 16 includes a detent spring 17 for fastening contact spring element 3 to first plug connector part 1.

As part of the electric connection detection device, contact spring element 3, made entirely of metal, takes on the function of a short circuit jumper that electrically connects two metal contact strips 5*a* and 5*b* situated on second plug connector part 2 as soon as the mechanical connection of the two plug connector parts 1 and 2 is fully established. The sectional views in FIGS. 1, 2, 3, and 4 show only one contact spring 3*a* and one contact strip 5*a* in each case. However, the description of their function analogously also applies to contact spring 3*b* and associated contact strip 5*b* at that location.

Second plug connector part 2 has an electrically insulating protrusion 6. Protrusion 6 forms a guide bevel 7. Guide bevel 7 rises in the joining direction of first plug connector part 1 toward second plug connector part 2. Spring contact 4*a* of contact spring 3*a* on first plug connector part 1 is guided over guide bevel 7 when plug connector parts 1 and 2 are joined together. At the end of the joining operation of plug connector parts 1 and 2, spring contact 4*a* of contact spring 3*a* on first plug connector part 1 rests behind protrusion 6 onto a portion of contact strip 5*a* on second plug connector part 2 (shown in FIG. 2).

FIG. 2 illustrates the final position during joining of plug connector parts 1 and 2. In the final position (i.e., plug connector parts 1 and 2 are fully joined with one another), contact spring 3*a* on first plug connector part 1 rests against contact strip 5*a* on second plug connector part 2 and thus establishes an electrical connection with same. Since this likewise applies for contact spring 3*b* and contact strip 5*b*, contact spring element 3 on first plug connector part 1 thus electrically bridges two contact strips 5*a* and 5*b* on second plug connector part 2. The electrical connection of contact strips 5*a* and 5*b* may be easily detected by an electronics system connected to contact strips 5*a* and 5*b* and may be used for control or monitoring purposes.

Two preceding joining phases of plug connector parts 1 and 2 are clarified by the illustrations in FIGS. 3 and 4. In an initial phase of joining the two plug connector parts 1 and 2 (shown in FIG. 3) the rounded section of spring contact 4*a* of contact spring 3*a* on first plug connector part 1 meets protrusion 6 on second connector part 2. As indicated above, protrusion 6 forms guide bevel 7 in the form of an oblique plane that rises in the insertion direction of first plug connector part 1 toward second plug connector part 2. During the initial phase of joining of plug connector parts 1 and 2, spring contact 4*a* of contact spring 3*a* slides along guide bevel 7 and onto protrusion 6. Contact spring 3*a* is thus tensioned perpendicularly with respect to the joining direction of plug connector parts 1 and 2.

In an intermediate phase of joining of the two plug connector parts 1 and 2 (shown in FIG. 4) spring contact 4*a* of contact spring 3*a* moves up to a highest rising point of guide bevel 7. Spring contact 4*a* further moves past the highest rising point of guide bevel 7 and passes over a short, slightly downwardly sloping area 18 of guide bevel 7.

In a final phase of joining of the two plug connector parts 1 and 2 (shown in FIG. 2) spring contact 4*a* of contact spring 3*a* passes over the downwardly sloping area 18 of guide bevel 7. Spring contact 4*a* ultimately engages behind protrusion 6 and contacts a portion of contact strip 5*a* on second plug connector part 2.

In embodiments of the electric plug connector arrangement, it is advantageous that mechanical and electrical connection between spring contacts 4*a* and 4*b* and contact strips 5*a* and 5*b* takes place quickly due to upstream protrusion 6 and quasi-abruptly due to the mechanically pre-tensioned contact springs 3*a*, 3*b*.

Relatively small contact surfaces 8 for spring contacts 4*a* and 4*b* of contact springs 3*a* and 3*b* on first plug connector part 1 may be provided on contact strips 5*a* and 5*b*, respectively, on second plug connector part 2 so that the positions at which spring contacts 4*a* and 4*b* establish electrical connections with contact strips 5*a* and 5*b* are precisely defined. For this purpose, an insulation material surrounding contact strips 5*a* and 5*b* may be provided to free only small-surface contact surfaces 8 as contact windows at which electrical connections with spring contacts 4*a* and 4*b* may be established. This ensures that the electric connection detection device generates the connection signal only when the two plug connector parts 1 and 2 are precisely in their final connecting position, in which first and second plug contact elements 12 and 13 are also correctly positioned with respect to one another.

As further shown in FIGS. 1, 2, 3, 4, and 9, contact spring 3*a* has an opposite curvature above spring contact 4*a*. This causes contact spring 3*a* to lie closely against area 18 of protrusion 6.

Area 18 of protrusion 16 slopes downwardly in the connection direction of first plug connector part 1 toward second plug connector part 2. Area 18 of protrusion 16 forms a correspondingly rising area during a movement in the opposite direction (i.e., in a disconnection direction of first plug connector part 1 away from second plug connector part 2 and/or in a disconnection direction of second plug connector part 2 away from first plug connector part 1). As such, during a disconnection movement of plug connector parts 1 and 2, spring contact 4*a* is lifted off from contact strip 5*a* after only a short distance. A disconnection of plug connector parts 1 and 2 is thus recognized quickly by the electric connection detection device. Particularly, a disconnection of plug connector parts 1 and 2 is recognized before electrical connections between first and second plug contact elements 12 and 13 are interrupted.

Referring now to FIGS. 5, 6, 7, 8, and 10, a second electric plug connector arrangement will be described. The second electric plug connector arrangement differs from the first electric plug connector arrangement, shown in FIGS. 1, 2, 3, 4, and 9, by the configuration of the electrical contact elements of the electrical connection detection device.

In the electrical connection detection device of the second electric plug connector arrangement the connection detection contacts do not form short circuit jumpers on the first plug connector part which bridge contact strips on the second plug connector part. Instead, an additional electrical connection between the first and the second plug connector parts is established when the plug connector parts are correctly connected. Depending on where an electrical circuit system, which uses the signals of the electrical connection detection device, is situated, and which specific functions this circuit system provides, either the design of an electrical connection detection device as described above or as described below may be used in a particularly advantageous manner.

Figure 10:
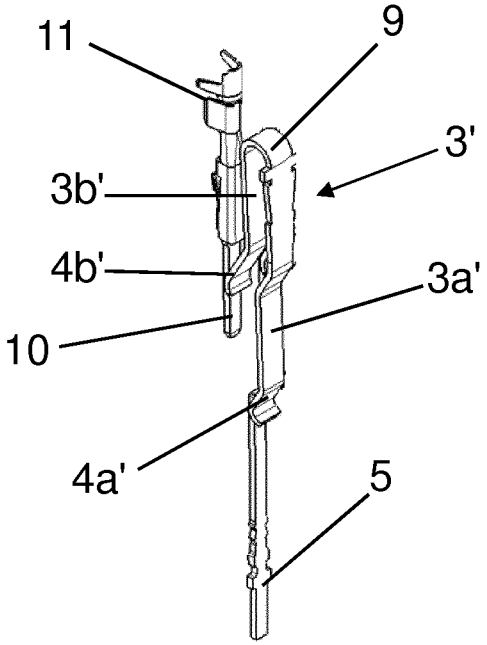
FIG. 10 illustrates the connection detection contacts of the electric connection detection device of the second electric plug connector arrangement shown in FIGS. 5, 6, 7, and 8.

FIG. 10 illustrates connection detection contacts of the electrical connection detection device of the second electric plug connector arrangement as individual parts. In contrast to the connection detection contacts of the first electric plug connector arrangement for detecting a connection as shown in FIG. 9, the parallel contact strips 5*a* and 5*b* of the electrical connection detection device of the second electric plug connector arrangement are not connected to one another on second plug connector part 2. Instead, an electrical connection between a contact pin 10 on first plug connector part 1' and a contact strip 5 on second plug connector part 2 is established. The contact arrangement illustrated in FIG. 10 may also be used multiple times in an electric plug connector arrangement to form, for example, a multipole or redundantly acting connection detection device.

The electrical connection between contact pin 10 on first plug connector part 1' and contact strip 5 on second plug connector part 2 is provided via a contact spring element 3' on first plug connector part 1'. Contact spring element 3' has a U-shaped, bent section 9 that connects two contact springs 3*a*' and 3*b*' to one another as one piece. Contact springs 3*a*' and 3*b*' at their outer end sections in each case form a spring contact 4*a*' and 4*b*', respectively.

Figure 5:
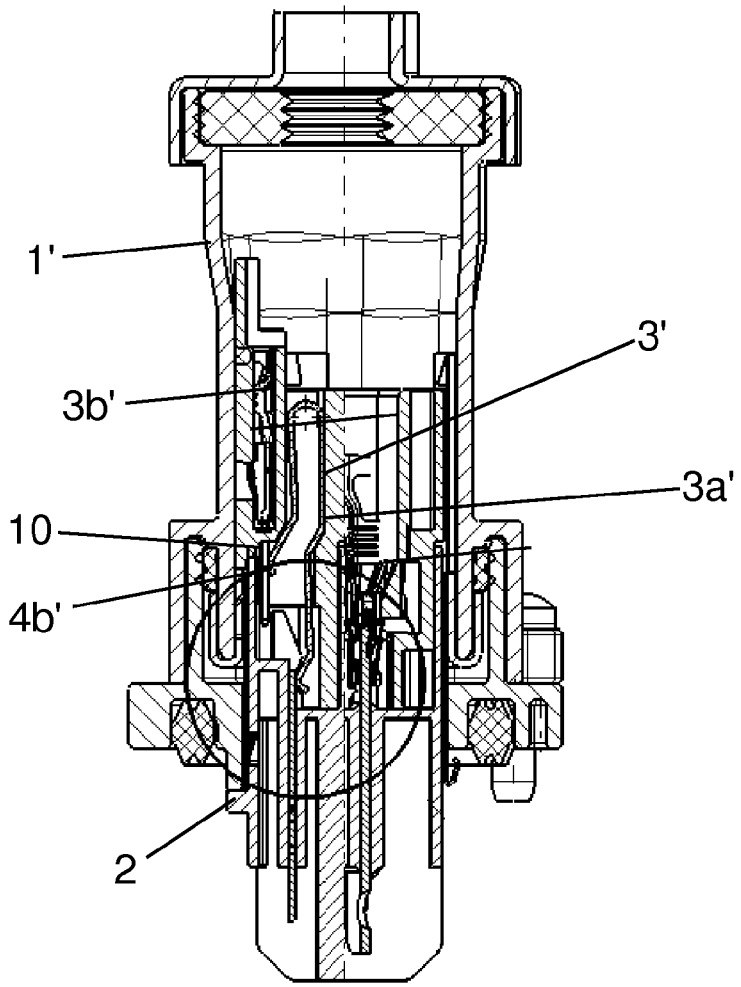
FIG. 5 illustrates a sectional view of a second electric plug connector arrangement, the second electric plug connector arrangement having a first plug connector part, a second plug connector part, and an electric connection detection device.
Figure 6:
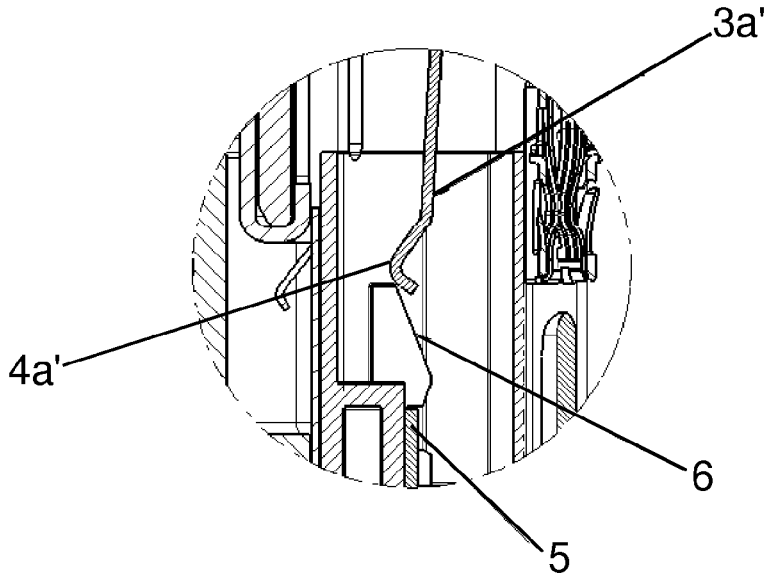
FIG. 6 illustrates an enlarged view of the circled area in FIG. 5 of the second electric plug connector arrangement when the first and second plug connector parts are in an initial joining position between one another.
Figure 7:
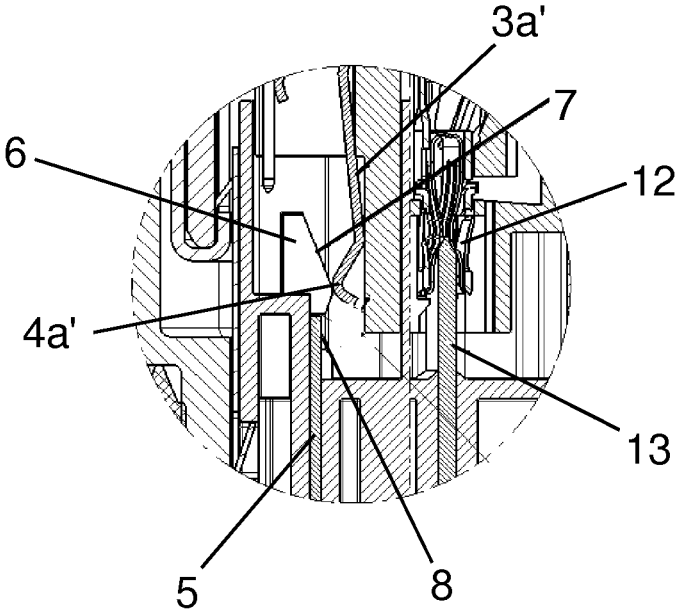
FIG. 7 illustrates an enlarged view of the circled area in FIG. 5 of the second electric plug connector arrangement when the first and second plug connector parts are in an intermediate joining position between one another.
Figure 8:
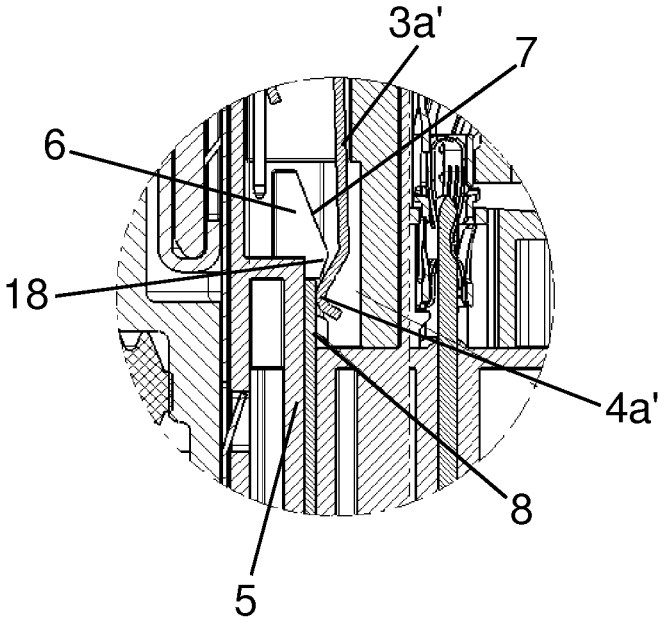
FIG. 8 illustrates an enlarged view of the circled area in FIG. 5 of the second electric plug connector arrangement when the first and second plug connector parts are in a final joining position between one another.

As shown in FIG. 5, spring contact 4*b*' rests against contact pin 10 situated in first plug connector part 1', thus electrically connecting the contact pin to contact spring element 3'. In contrast to spring contact 4*a*' and contact strip 5, spring contact 4*b*' is not moved against contact pin 10. Thus, spring contact 4*b*' forms a fixed electrical connection with contact pin 10. A connecting line (not shown) leading out from first plug connector part 1' may be fastened to crimped section 11 of contact pin 10.

Contact pin 10 could be designed in one piece with contact spring element 3'. However, this would result in an object having a relatively complex shape, which would be complicated to manufacture and install. In addition, the option of selecting different materials for contact spring element 3' and contact pin 10 would have to be waived. For these reasons, it is advantageous to electrically connect contact pin 10 via spring contact 4*b*' as illustrated.

Spring contact 4*a*', in a manner analogous to that employed in the first electric plug connector arrangement, is led over protrusion 6 on second plug connector part 2 during the connection of the two plug connector parts 1', 2. Spring contact 4*a*' comes to rest behind protrusion 6 against a portion of contact strip 5. Consequently, the electrical contacts of the connection detection device are closed. The structures and sequences of the connection phases illustrated in FIGS. 6, 7, and 8 correspond to the sequences described with reference to FIGS. 2, 3, and 4. As such, further explanation at this point is dispensed.

LIST OF REFERENCE NUMERALS

1, 1' first plug connector part
2 second plug connector part
3, 3' contact spring element
3*a*, 3*b*, 3*a*', 3*b*' contact springs
4*a*, 4*b*, 4*a*', 4*b*' spring contacts
5, 5*a*, 5*b* contact strips
6 protrusion
7 guide bevel
8 contact surfaces
9 U-shaped bent section
10 contact pin
11 crimped section
12 first plug contact elements
13 second plug contact elements
14 passage opening
15 radial seal
16 connecting section
17 detent spring
18 downwardly sloping area While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical connector comprising:

a first connector part;

a second connector part;

an electrical connection detector including a contact spring with a spring contact on the first connector part and a contact strip on the second connector part, wherein the electric connection detector establishes an electrical connection between the contact spring and the contact strip when the connector parts are joined together;

wherein the second connector part includes an electrically insulating protrusion which forms a guide bevel that rises in a joining direction of the first connector part toward the second connector part; and wherein the spring contact is guided over the guide bevel as the connector parts are being joined together and rests behind the protrusion and physically contacts the contact strip when the connector parts are joined together to thereby establish an electrical connection between the contact spring and the contact strip with the contact spring lying against the protrusion so that during an initial disconnection movement of the joined together connector parts in a direction opposite to the joining direction the spring contact lifts off from the contact strip prior to the connector parts being disconnected from one another.

2. The electrical connector of claim 1 wherein:

the contact spring is part of a unitary contact spring assembly further including a second contact spring with a second spring contact.

3. The electrical connector of claim 2 wherein:

the second connector part further includes a second electrically insulating protrusion which forms a second guide bevel that rises in the joining direction of the first connector part toward the second connector part; and the second spring contact of the second contact spring is guided over the second guide bevel, rests behind the second protrusion, and physically contacts a second contact strip on the second connector part when the connector parts are joined together.

4. The electrical connector of claim 2 wherein:

the unitary contact spring assembly further includes a connecting section; and the contact springs are in parallel to one another and via the connecting section are connected to one another.

5. The electrical connector of claim 1 wherein:

the protrusion of the second connector part has an area that slopes downwardly in the joining direction of the first connector part toward the second connector part, the downwardly sloping area of the protrusion follows the guide bevel in the joining direction of the first connector part toward the second connector part, and the downwardly sloping area of the protrusion being shorter in length than the guide bevel; and the contact spring lying against the protrusion when the connector parts are joined together includes the contact spring lying against the downwardly sloping area of the protrusion.

6. The electrical connector of claim 1 wherein:

the spring contact has a rounded, semicircular, cross-section.

7. The electrical connector of claim 1 wherein:

the contact strip leads out through a wall of the second connector part.

8. An electrical plug connector comprising:

a first plug connector part having a first plug contact;

a second plug connector part having a second plug contact;

an electrical connection detector including a contact spring with a spring contact on the first plug connector part and a contact strip on the second plug connector part, the spring contact forming an end section of the contact spring, the spring contact having a curvature, and an intermediate section of the contact spring adjacent the spring contact having a curvature oppositely shaped than the curvature of the spring contact, wherein the electric connection detector establishes an electrical connection between the contact spring and the contact strip when the plug connector parts are joined together;

wherein the second plug connector part includes an electrically insulating protrusion which forms a guide bevel that rises in a joining direction of the first plug connector part toward the second plug connector part, the protrusion having an area that slopes downwardly in the joining direction of the first plug connector part toward the second plug connector part, and the downwardly sloping area of the protrusion follows the guide bevel in the joining direction of the first plug connector part toward the second plug connector part; and wherein the spring contact is guided over the guide bevel as the plug connector parts are being joined together and rests behind the protrusion and physically contacts the contact strip when the plug connector parts are joined together to thereby establish an electrical connection between the contact spring and the contact strip with a portion of the intermediate section of the contact spring lying against the downwardly sloping area of the protrusion so that during an initial disconnection movement of the joined together connector parts in a direction opposite to the joining direction the spring contact lifts off from the contact strip prior to the connector parts being disconnected from one another.

9. The electrical plug connector of claim 8 wherein:

the contact spring is part of a unitary contact spring assembly further including a second contact spring with a second spring contact.

10. The electrical plug connector of claim 9 wherein:

the second connector part further includes a second electrically insulating protrusion which forms a second guide bevel that rises in the joining direction of the first connector part toward the second connector part; and the second spring contact of the second contact spring is guided over the second guide bevel, rests behind the second protrusion, and physically contacts a second contact strip on the second plug connector part when the plug connector parts are joined together.

11. The electrical plug connector of claim 9 wherein:

the unitary contact spring assembly further includes a connecting section; and the contact springs are in parallel to one another and via the connecting section are connected to one another.

12. The electrical plug connector of claim 9 wherein:

the unitary contact spring assembly further includes a U-shaped, bent section;

the contact springs are connected to one another via the U-shaped, bent section;

the first plug connector part further includes a contact pin; and the second spring contact of the second contact spring is attached to the contact pin.

13. The electrical plug connector of claim 8 wherein:

the spring contact has a rounded, semicircular, cross-section.

14. The electrical plug connector of claim 8 wherein:

the first plug contact and the second plug contact plug into one another when the plug connector parts are joined together.

15. The electrical plug connector of claim 8 wherein:

the contact strip leads out through a wall of the second plug connector part.

16. An electrical connector comprising:

a first connector part;

a second connector part;

an electrical connection detector including a contact spring with a spring contact on the first connector part and a contact strip on the second connector part, wherein the electric connection detector establishes an electrical connection between the contact spring and the contact strip when the connector parts are joined together;

wherein the second connector part includes an electrically insulating protrusion which forms a guide bevel that rises in a joining direction of the first connector part toward the second connector part;

wherein the spring contact is guided over the guide bevel, rests behind the protrusion, and physically contacts the contact strip when the connector parts are joined together to thereby establish an electrical connection between the contact spring and the contact strip;

wherein the contact spring is part of a unitary contact spring assembly further including a second contact spring with a second spring contact; and wherein the unitary contact spring assembly further includes a U-shaped, bent section;

the contact springs are connected to one another via the U-shaped, bent section;

the first connector part includes a contact pin; and the second spring contact of the second contact spring is attached to the contact pin.

* * * * *